US007686181B2

(12) United States Patent
St-Onge

(10) Patent No.: US 7,686,181 B2
(45) Date of Patent: Mar. 30, 2010

(54) STACKABLE EGG-BOX, STACK OF EGG-BOXES AND METHOD FOR DESTACKING SAID EGG-BOX

(75) Inventor: Yves St-Onge, Blainville (CA)

(73) Assignee: Interplast Packaging Inc., Teprebonne (CA)

( * ) Notice: Subject to any disclaimer, the term of this patent is extended or adjusted under 35 U.S.C. 154(b) by 754 days.

(21) Appl. No.: 11/320,843

(22) Filed: Dec. 30, 2005

(65) Prior Publication Data

US 2007/0151892 A1 Jul. 5, 2007

(51) Int. Cl.
*B65D 85/00* (2006.01)
*B65D 45/16* (2006.01)

(52) U.S. Cl. ..... 220/508; 220/324; 220/810

(58) Field of Classification Search ..... 206/521.1, 206/519, 518, 516, 515, 521.15; 220/508, 220/324, 799, 367.1, 810, 608, 604, 507, 220/796; D9/762, 757

See application file for complete search history.

(56) References Cited

U.S. PATENT DOCUMENTS

| | | | | | |
|---|---|---|---|---|---|
| 1,507,133 | A | * | 9/1924 | Loeble | 220/508 |
| 2,655,303 | A | * | 10/1953 | Cox | 206/521.15 |
| 3,131,846 | A | * | 5/1964 | Whiteford | 206/521.8 |
| 3,356,277 | A | * | 12/1967 | Hohnjec | 206/521.8 |
| 3,522,061 | A | * | 7/1970 | Whiteford | 426/111 |
| 3,655,110 | A | * | 4/1972 | Eisenbach | 229/406 |
| 3,771,712 | A | * | 11/1973 | Richards | 206/521.1 |
| 4,057,188 | A | * | 11/1977 | Steinhardt | 206/521.8 |
| 4,090,658 | A | * | 5/1978 | Fukuda | 206/521.1 |
| 4,205,777 | A | * | 6/1980 | Brown et al. | 206/521.1 |
| 4,553,692 | A | * | 11/1985 | Padovani | 206/521.1 |
| 4,650,076 | A | * | 3/1987 | Padovani | 206/526 |
| 5,456,379 | A | * | 10/1995 | Krupa et al. | 220/835 |
| 5,927,501 | A | * | 7/1999 | Herbruck | 206/541 |
| 6,012,583 | A | * | 1/2000 | Ramirez | 206/521.1 |
| 2005/0189256 | A1 | | 9/2005 | St-Onge | |

FOREIGN PATENT DOCUMENTS

| | | | |
|---|---|---|---|
| CA | 2028229 | | 1/2003 |
| GB | 2141403 | A * | 12/1984 |

* cited by examiner

*Primary Examiner*—Anthony Stashick
*Assistant Examiner*—Robert J Hicks
(74) *Attorney, Agent, or Firm*—Ogilvy Penault LLP

(57) ABSTRACT

A stackable tray obtained by vacuum molding of a sheet of plastic material, the tray comprising, in open position: a) a top and a bottom; b) at least one receiving cavity opened upwardly; c) a hinge portion dividing the tray into a cover portion and a base portion; the receiving cavity being at least provided in the base portion; d) spacing members to keep, in a stack of trays, the top portion and the bottom portion of neighboring trays at distance from each other to thereby prevent interlocking therebetween; and e) at least one two-part locking members, each part being provided in the top of the sheet and positioned to engage one into the other when the cover portion is folded over the base portion along the hinge portion to bring the tray into a closed position defining a box. A stack of the trays and a method using the trays are also provided.

17 Claims, 12 Drawing Sheets

STACKABLE EGG-BOX, STACK OF EGG-BOXES AND METHOD FOR DESTACKING SAID EGG-BOX

FIELD OF THE INVENTION

The invention relates to an improvement in trays obtained by vacuum moulding of a sheet of plastic material and intended to be stacked one into the other. More particularly, each of said trays defines an egg-box into an opened position.

BACKGROUND OF THE INVENTION

It is known in the art to obtain trays by thermoforming techniques, especially vacuum moulding, and to stack them one into the other. It is also known to stack trays defining an egg-box into an opened position (see Applicant's Canadian Patent No. 2,028,229). However, when trays are stacked one into the other, friction and/or air lock maybe created between neighboring trays. Such interlocking of trays involves that when a tray is picked up (or denested) from the stack, one or several neighboring trays may be simultaneously picked up. This drawback becomes very important when said stack of trays is intended to feed an automated packaging and/or labeling apparatus, especially an apparatus intended to fill egg-box trays with eggs. Indeed, when the apparatus becomes jammed, it has to be stopped and an operator must manually remove the trays from the apparatus. There is a substantial lost of productivity and of course substantial risks of damaging the apparatus.

It is also known in Applicant's co-pending U.S. application Ser. No. 10/934,400 which is hereby incorporated by reference to obtain stackable tray by vacuum molding of a sheet of plastic material, said tray comprising, in open position:

a) a top and a bottom;

b) at least one receiving cavity opened upwardly; and c) spacing means to keep, in a stack of trays, the top portion and the bottom portion of neighboring trays at distance from each other to thereby prevent interlocking between adjacent trays.

However, when such a tray defines an egg-box of large size, for example for 18 eggs or more, it appears that said box resulting from the folding of a cover portion over a portion provided with egg receiving cavities, does not present a level of rigidity allowing to prevent deformation of the box and to optimize the protection of its fragile content.

Therefore, there is a need for trays of the type as defined in co-pending U.S. application Ser. No. 10/934,400 that can be stacked one into the other without creation of air lock or friction between neighboring trays, that can allow an easy removal of each tray from the stack of trays and whose box resulting from the folding of a cover portion over another portion provided with egg receiving cavities, will present a sufficient rigidity to protect adequately its fragile content.

SUMMARY OF THE INVENTION

The Applicant has now discovered an innovative manner to interlock the cover portion of the tray with a base portion of said tray that is provided with receiving cavities (especially egg receiving cavities), to thereby overcome the drawback existing with prior art trays.

More particularly, the invention relates to a stackable tray obtained by thermoforming, especially vacuum molding, of a sheet of plastic material. Said tray comprises, in open position:

a) a top and a bottom;

b) at least one receiving cavity opened upwardly;

c) a hinge portion dividing said tray into a cover portion and a base portion; said receiving cavity being at least provided in said base portion;

d) spacing means to keep, in a stack of trays, the top portion and the bottom portion of neighboring trays at distance from each other to thereby prevent interlocking therebetween; and e) at least one two-part locking means, each part being provided in the top of the sheet and positioned to engaged one into the other when the cover portion is folded over the base portion along the hinge portion to bring the tray into a closed position defining a box. Preferably, the two-part locking means comprises a first two-part locking means provided at an intermediate portion of the cover portion and base portion, and at least a second two-part locking mans provided in a peripheral portion of the cover portion and base portion.

Advantages of said trays amongst others, are at least the following:

resistant, good protection of the integrity of its contents, especially egg-shells, during packaging, storing and transport, even for large size boxes;

light in weight and inexpensive to manufacture;

may define a plate or bowl for receiving meals to be eaten by a traveler in a public transport (e.g jet planes, buses, trains, etc.);

discourages the opening of the box by a customer in a grocery store;

when in close position, has an interlocking system preventing accidental opening of said box and preferably cooperating with edge of the cover portion, base portion and hinge portion to give said box a substantial rigidity preventing deformation of the box and thereby damage to its fragile content;

Advantageously, according to a preferred embodiment, the invention also relates to a tray defining an egg-box obtained from a rectangular sheet of plastic and provided with a plurality of egg receiving cavities. Of course, other kind of boxes may be considered within the field of the invention. For example, said boxes may be a lunch box, a box for various articles (food articles or not), etc.

Advantageously, the sheet of plastic material may consist of any appropriate thermoplastic material. Preferably, the sheet can be made of polyethylene terephthalate. Of course any equivalent thermoplastic sheet that can be thermoformed, especially by vacuum molding, may be used. The thickness of said sheet may vary between wide limits so far it is still possible to embody said tray by thermoforming techniques such as vacuum molding. Preferably, said thickness may be of 14 mil. Preferably, a clear and transparent thermoplastic sheet is used.

Said trays may be obtained by any usual thermoforming techniques such as vacuum molding (e.g. by forming a sheet of thermoplastic material under the action of heat (e.g. by thermal convection)) and a mechanical stress. Preferably said mechanical stress may be obtained by air vacuum created at the base of the mould thanks to air vacuum nozzles. Such techniques are well known to a skilled workman and do not necessitate any substantial description in the present disclosure.

Advantageously, according to another preferred embodiment, each egg receiving cavity of the base portion may be further provided with a set of at least three (more preferably six) inwardly projecting ribs for supporting an egg. Said ribs have a lower portion substantially straight in the bottom of the cavity and an upper portion curved to substantially fit with a corresponding contour of an egg.

Optionally, as in co-pending U.S. application Ser. No. 10/934,400 and according to another preferred embodiment, the cover portion may be further provided with egg receiving cavities for the upper portion of eggs. Preferably, each of said receiving cavity of the cover portion may be further provided with a set of at least three (more preferably six) inwardly projection ribs allowing to minimize movement of an egg housed in said cavities of the base portion and cover portion. Advantageously, said ribs may have a portion substantially straight near the bottom of the cavity and a portion substantially curved to substantially fit with a corresponding contour of an egg.

Said ribs are preferably equidistant. However, they could be distributed in a different way. The side of compartment is such to receive an egg shell of predetermined size (e.g. small, medium, large, extra-large, etc. ). The egg shell is introduced in the compartment and is supported by ribs, rather than by the side wall or by the bottom. The egg shell is advantageously at distance from the bottom of said cavity.

The fact that the egg shell is retained by ribs is particularly advantageous in order to preserve the integrity of the egg shell. Indeed, any impact of the container with an outside object will prevent a direct impact on the egg shell, this later being at distance from the bottom of the container and from the side wall by ribs. Said ribs are not directly in contact with the outside of the container.

Advantageously, according to another preferred embodiment, spacing means are stoppers having a portion thereof provided with negative angle, an upper portion and a lower portion, said upper portion and lower portion of each stopper, when said tray is in open position, facing corresponding lower portion and upper portion of neighboring trays to keep a gap between said trays and prevent them to become interlocked.

A man skilled in the art was not encouraged to embody a molded article by thermoforming, especially vacuum moulding, while said article has negative angles because the risk of having this article locked on the mould. However, surprisingly, the article can be easily removed from the mould to thereby allow the manufacture of trays provided with stoppers allowing to space apart neighboring trays in a stack of trays (in open position).

Advantageously, according to another preferred embodiment, the cover portion and the base portion are each provided with a peripheral flange, said flanges being sized to fit one against the other when the cover portion is folded over the base portion along the hinge portion. Optionally, said peripheral flanges may be further shaped to define at least a second two part locking means. Each part of said second two part locking means being provided with at least one protuberance engaging a corresponding cavity substantially perpendicularly to the plane of the original sheet.

Advantageously, according to another preferred embodiment, the cover portion may be further provided with at least one substantially flat surface for receiving thereon a printed label, a printed stamp or both. For example, said flat surface may support an advertising label, and information stamp (printed directly on the surface), or both. Optionally, said label may be glued on said surface (preferably inside the cover portion).

Optionally, as mentioned in Applicant's co-pending U.S. application Ser. No. 10/934,400, the cover portion may be provided with at least one venting opening (preferably four or eight venting openings). These venting openings allow a good ventilation of the inside of the box to thus prevent the gathering of humidity therein and allow a better preservation of its content (e.g. eggs). Preferably, according to a particularly preferred embodiment of the present invention, said venting openings may be provided in the cover portion and the base portion. More preferably, when venting opening are provided in the base portion, a venting channel may be advantageously further provided in the peripheral flange, said venting channel allowing to make easier the fluid communication of air between said venting opening and the interior of the box.

Optionally, as mentioned in Applicant's co-pending U.S. application Ser. No. 10/934,400, said tray may be further provided with means for facilitating the denesting by an automated packaging and/or labeling apparatus. Preferably, said means may comprise projecting members provided on the outside of cavities near ends of the tray. More particularly, projecting members are provided by pair on the outside of each cavities near ends of the tray to thus define a receiving track for a denesting tool.

The invention also relates to a stack of trays as defined hereinbefore.

The invention further relates to a method for denesting trays from a stack of empty trays to feed an automated packaging and/or labeling apparatus, said method comprising a step in which trays are successively picked up from a stack of trays as defined hereinbefore. Advantageously, a tool (e.g. a fork like tool) which is part of a packaging and/or labeling apparatus, engages the track defined by the projecting members and denests a tray from the bottom of the stack to feed said apparatus.

BRIEF DESCRIPTION OF PREFERRED EMBODIMENTS AS REPRESENTED IN THE DRAWINGS

Figure 1:
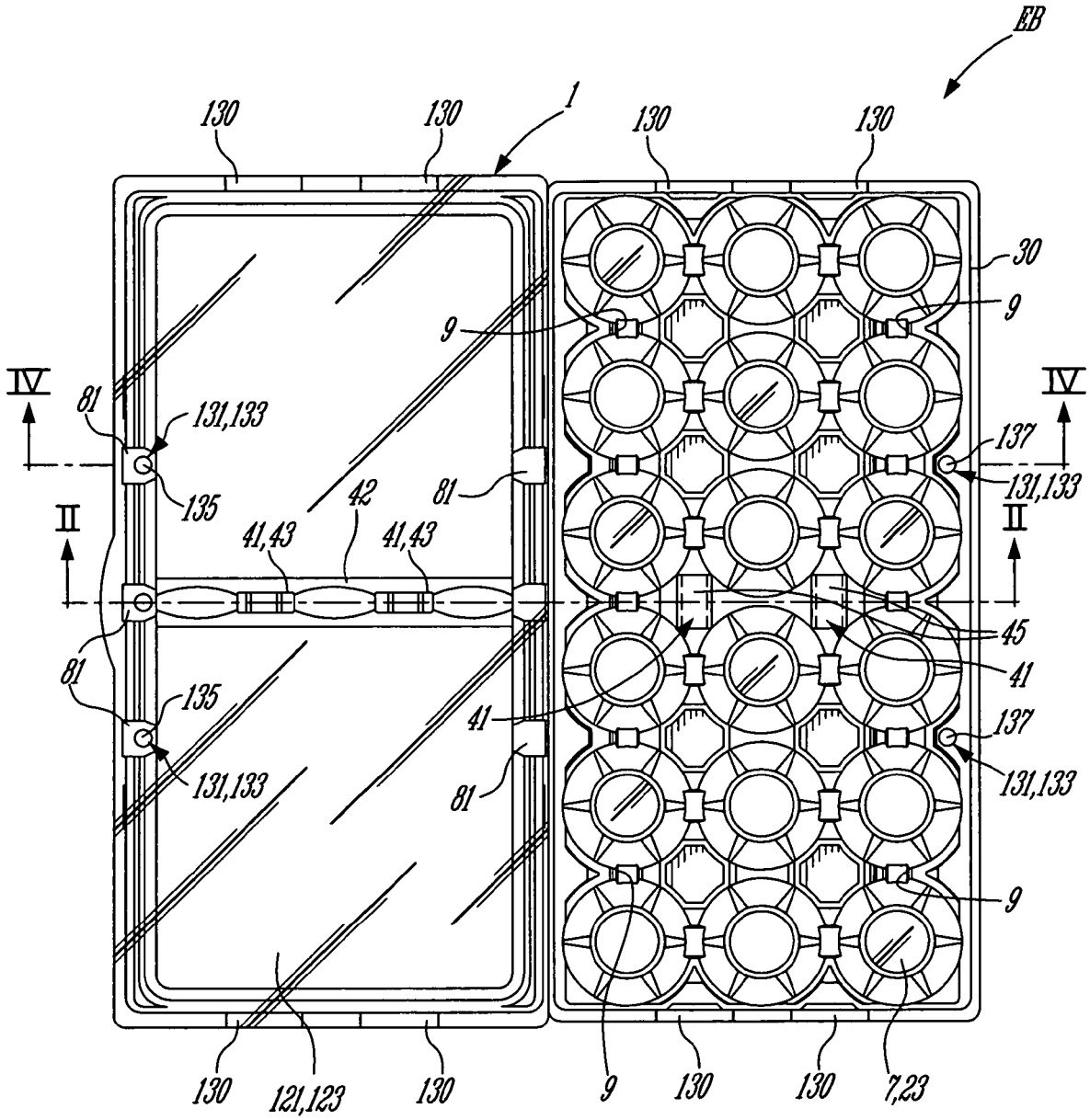
FIG. 1 is a top plan view of a preferred embodiment of a tray according to the invention.
Figure 2:
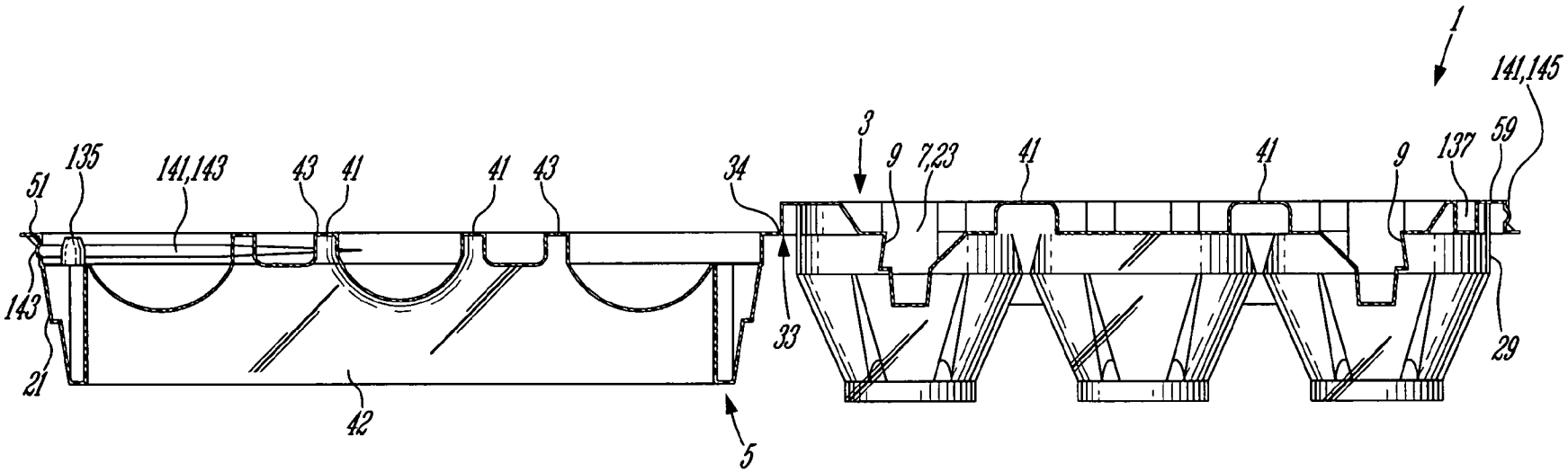
FIG. 2 is cross sectional view of the tray of FIG. 1 according to line II-II.
Figure 2A:
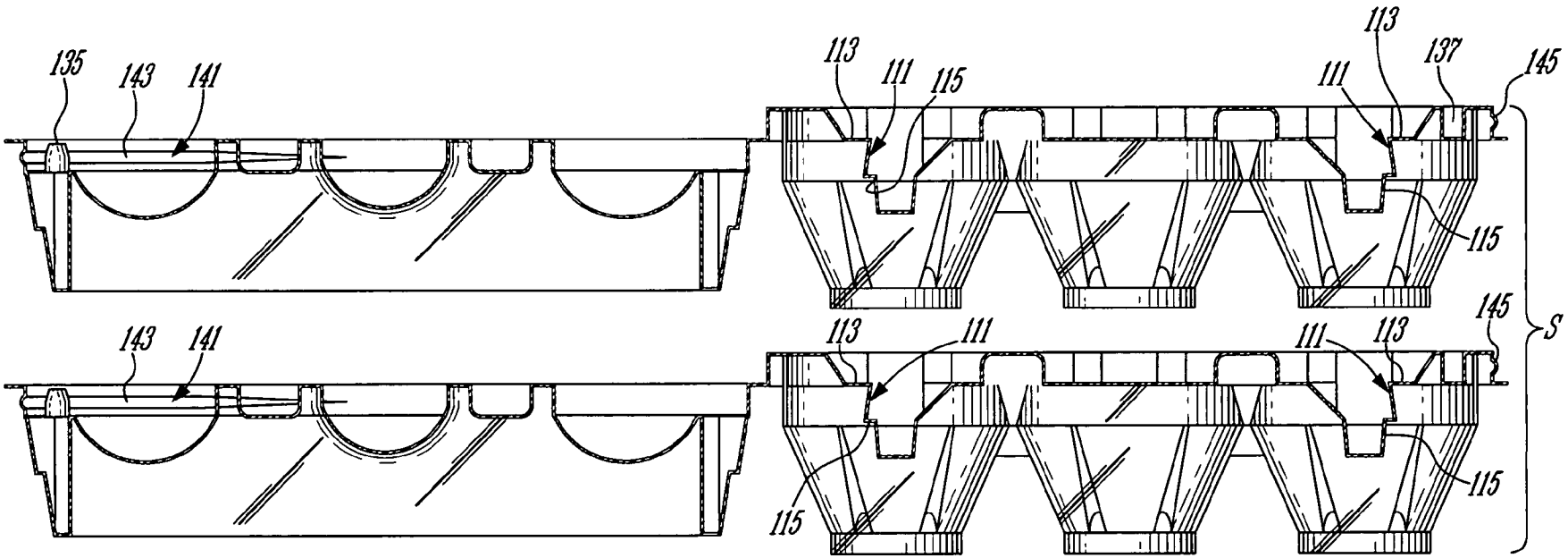
FIG. 2*a* is a cross sectional view of the tray of FIG. 2 showing how works spacing means.
Figure 3:
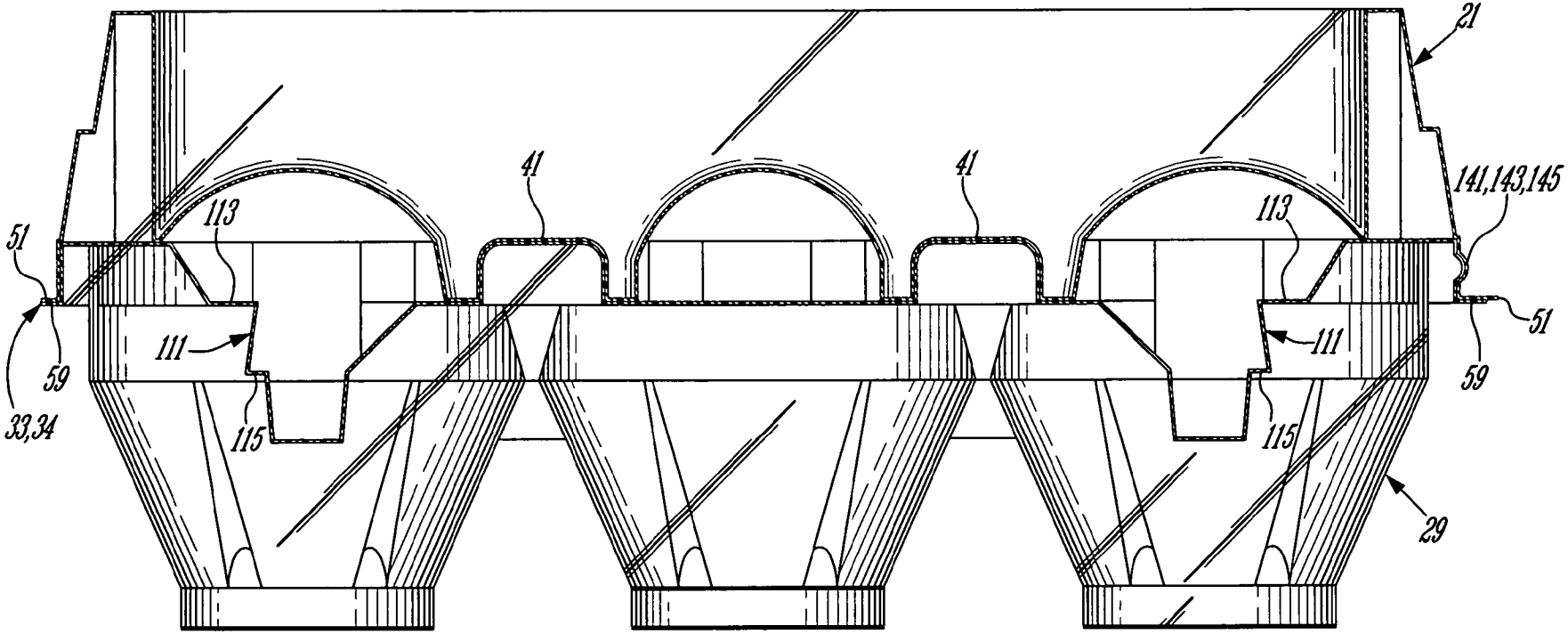
FIG. 3 is a cross sectional view of the tray of FIG. 1 (according to line II-II and with its cover portion tilted over the base portion)
Figure 4:
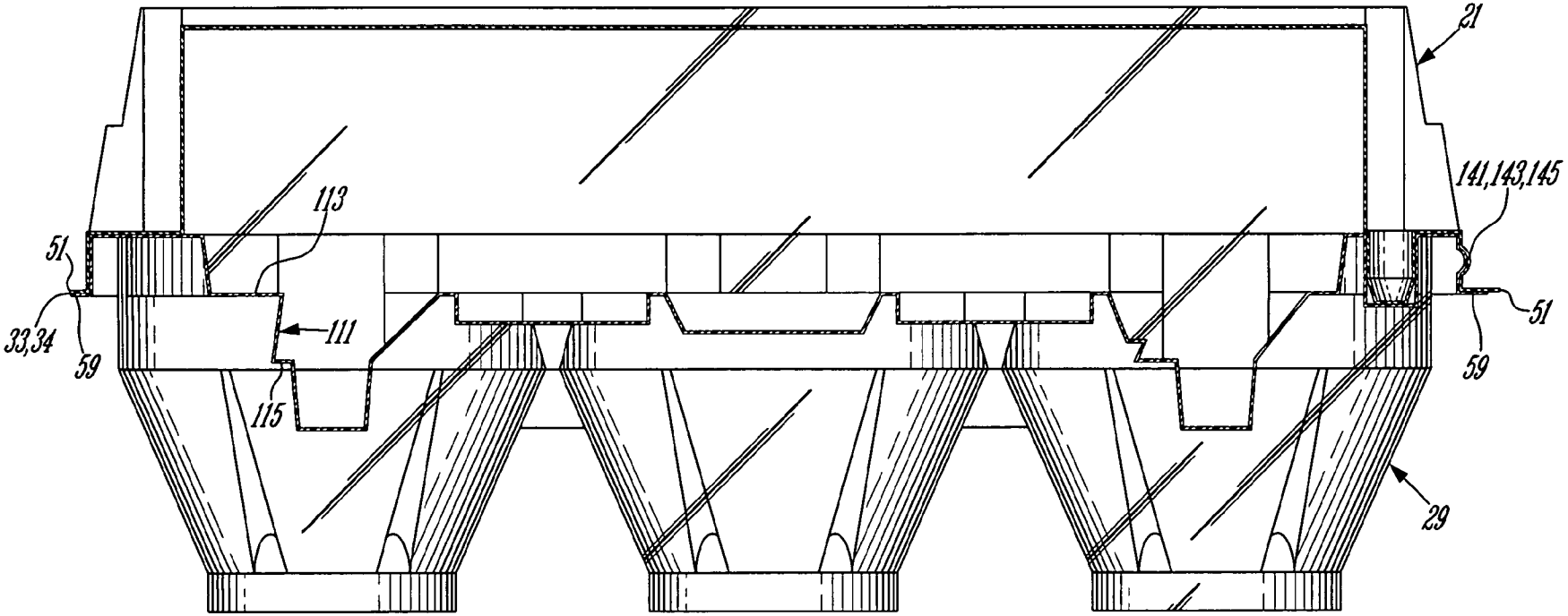
FIG. 4 is a cross sectional view of the tray of FIG. 1 according to line IV-IV showing a preferred embodiment of a second two part locking means when said tray has its cover portion tilted over the base portion.
Figure 7:
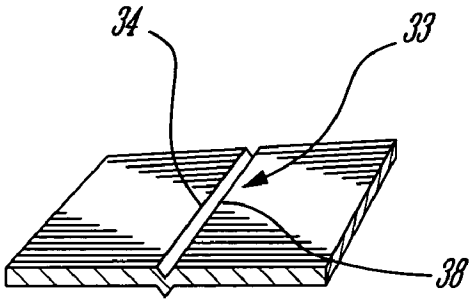
FIG. 7 is a partial view of the tray of FIG. 1 showing a preferred embodiment of a hinge according to the invention.
Figure 10:
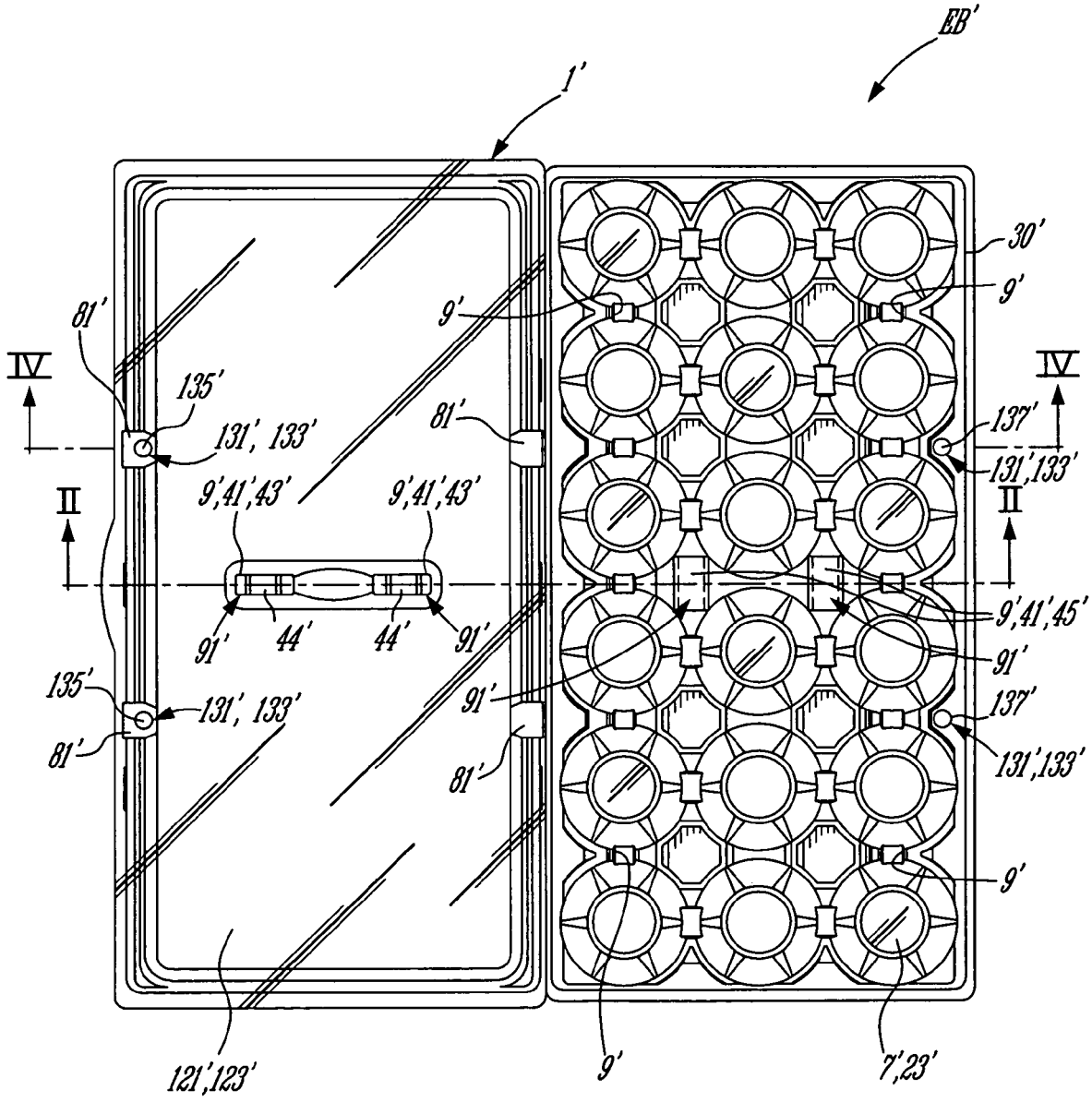
FIG. 10 is a top plan view of a variant of the tray of FIG. 1.
Figure 11:
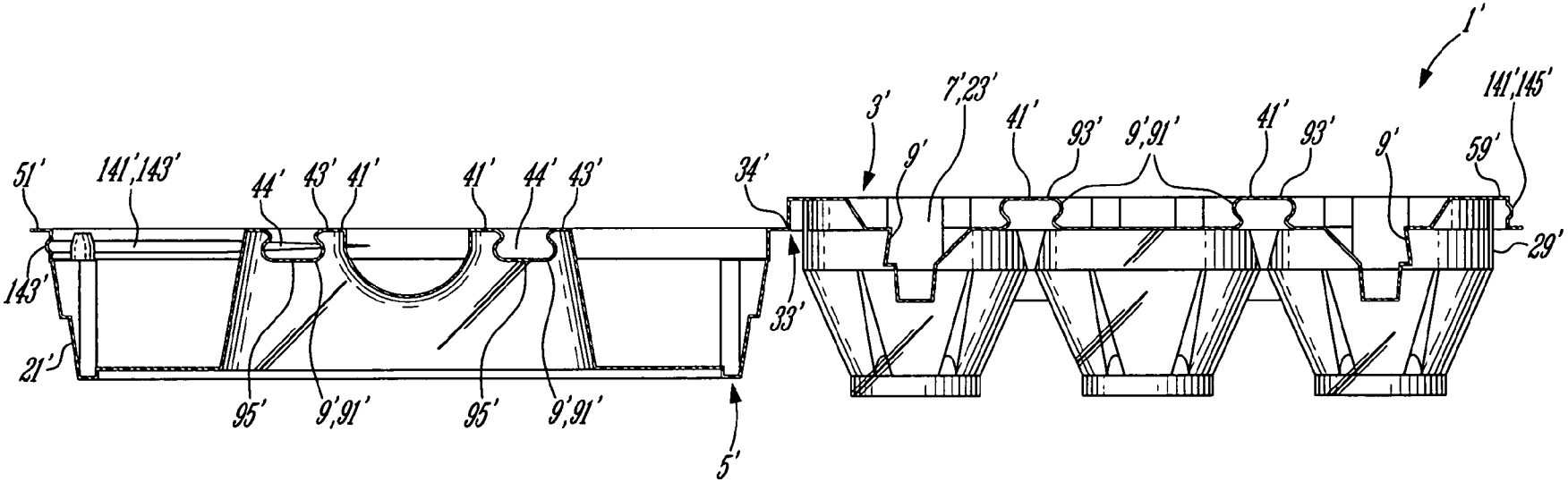
FIG. 11 is cross sectional view of the tray of FIG. 1 according to line II-II.
Figure 12:
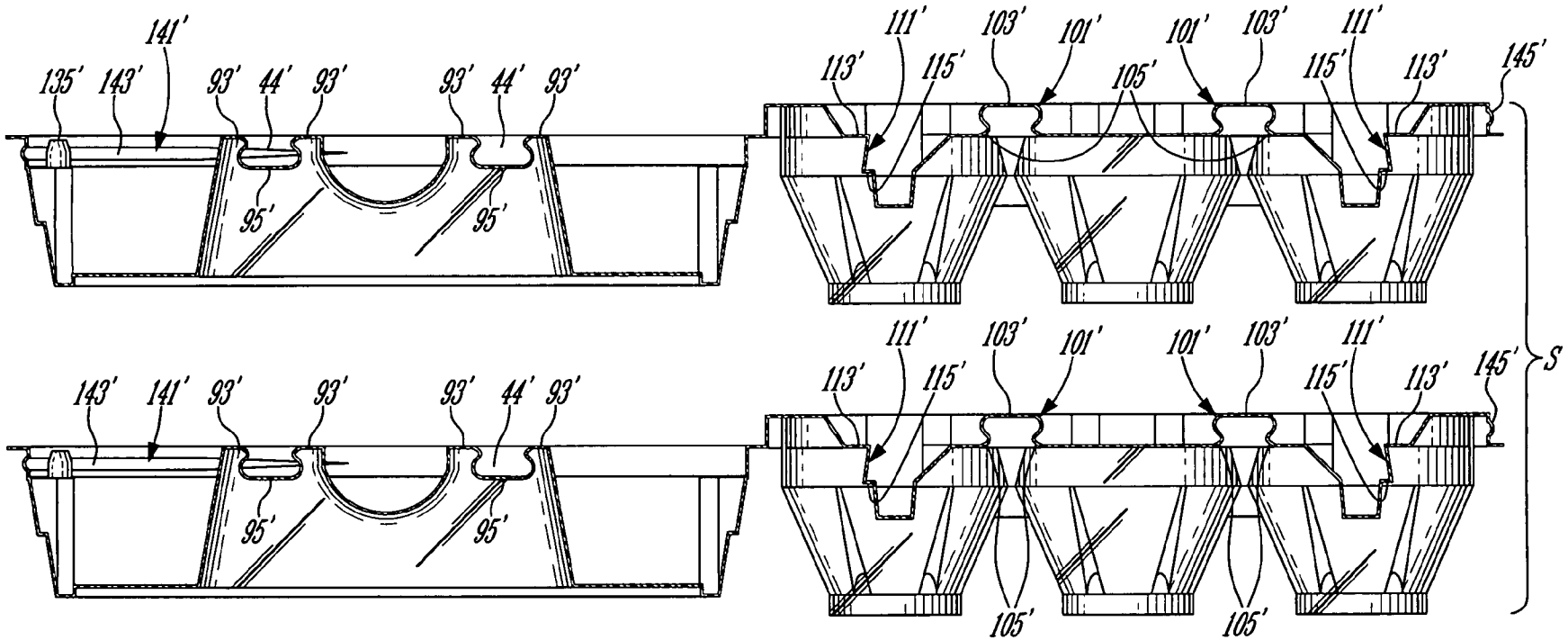
FIG. 12 is a cross sectional view of the tray of FIG. 11 showing how works spacing means.
Figure 13:
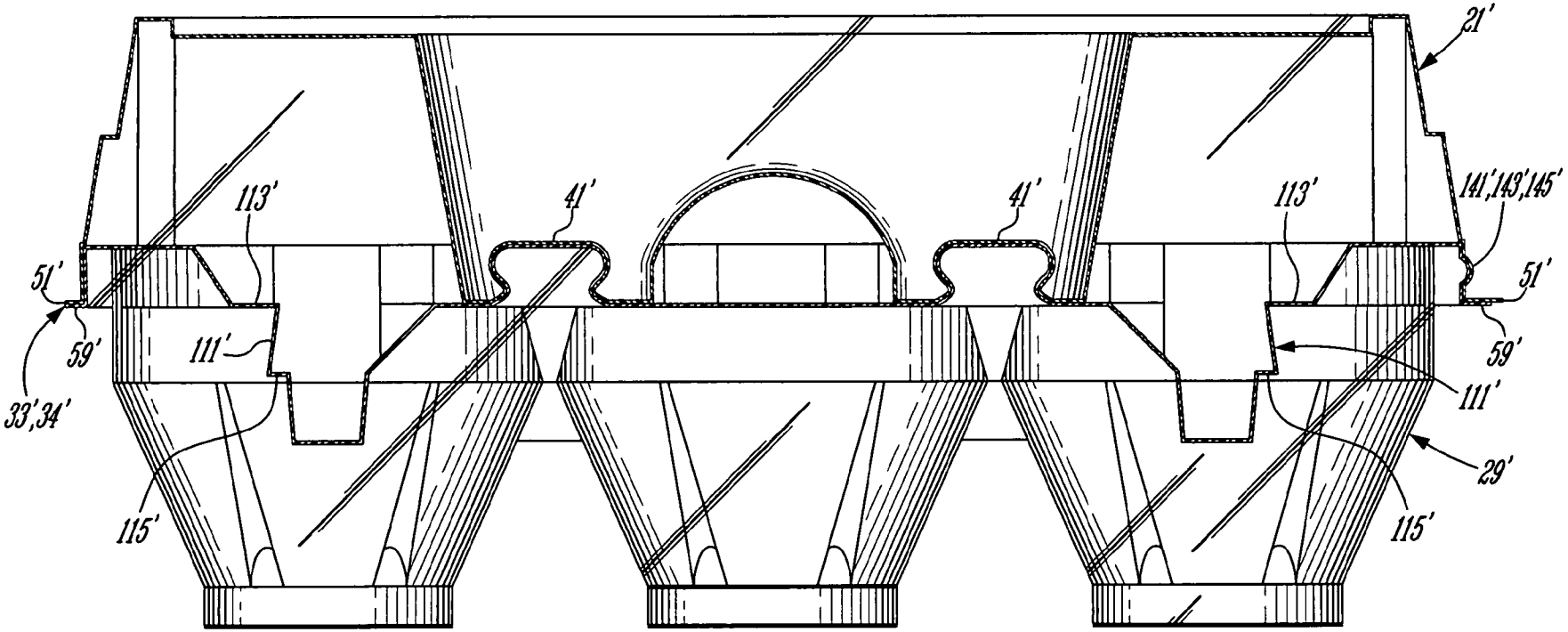
FIG. 13 is a cross sectional view of the tray of FIG. 10 (according to line II-II and with its cover portion tilted over the base portion)
Figure 14:
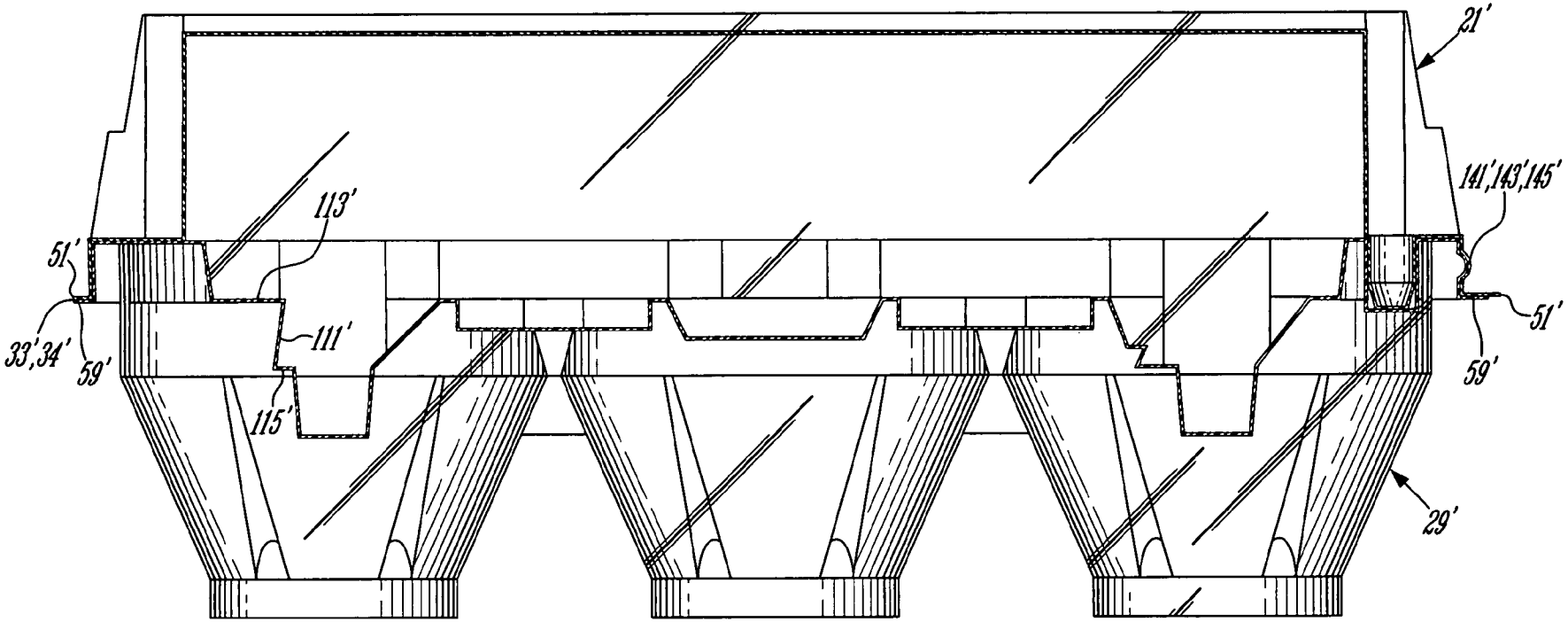
FIG. 14 is a cross sectional view of the tray of FIG. 10 according to line IV-IV showing a preferred embodiment of a second two part locking means when said tray has its cover portion tilted over the base portion.

With reference to the enclosed drawings, there is represented in FIG. 1 a particularly preferred embodiment of the invention, that is a stackable tray 1 obtained by vacuum molding of a sheet of thermoplastic sheet, especially a transparent polyethylene terephthalate sheet having a 14 mil thickness. This tray 1 comprises, in open position:

a) a top portion 3 and a bottom portion 5;

b) at least one receiving cavity 7 opened upwardly;

c) a hinge portion 33 dividing said tray 1 into a cover portion 21 and a base portion 29; said receiving cavity 7 being at least provided in said base portion 29;

d) spacing means 9 to keep, in a stack S of trays 1, the top portion 3 and the bottom portion 5 of neighboring trays 1 at distance from each other to thereby prevent interlocking therebetween (especially frictional or pneumatic interlocking); and e) at least one first two-part locking means 41, each part 43, 45 being provided in the top 3 of the sheet and positioned to engaged one into the other when the cover portion 21 is folded over the base portion 29 along the hinge portion 33 to bring the tray 1 into a closed position defining a box. In FIG. 10 there is represented a alternate variant of the tray 1. All identical parts of this alternate tray have same reference numbers than the tray shown in FIG. 1 except said reference numbers are now marked with a prime symbol (i.e. tray 1 becomes tray 1', top portion 3 becomes top portion 3', etc.) in order to avoid repetitive statements and clarification purposes.

Advantageously, the tray represented in FIG. 1 relates to a tray defining an egg-box EB provided with a plurality of egg receiving cavities 23. Of course, other boxes may be considered within the field of the invention. For example, said boxes may be a lunch box, a box for various articles (food articles or not), etc.

More particularly, as illustrated in the drawings, the egg-box EB may comprise a base portion 29 provided with the egg receiving cavities 23; a cover portion 21; a hinge portion 33 defining a hinge 34 between the cover portion 21 and the base portion 29.

Figure 8:
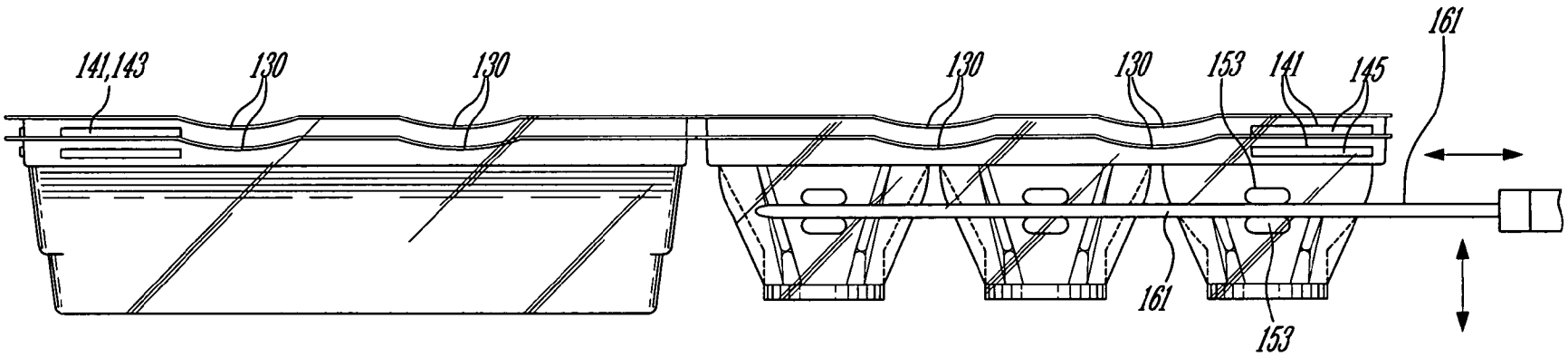
FIG. 8 is a schematic view of a packaging/labeling machine picking up trays from a stack of trays according to the invention.

As illustrated in FIG. 8 the hinge may merely consist in a fold made in the thermoplastic material. Alternatively, the hinge could be any well known variation of plastic hinges. It is preferred to have hinge 34 defined as a mere fold in the plastic material. Such hinges are easy to manufacture and inexpensive. They can be made by any appropriate technique well known in the art. For example, the plastic sheet may be partially cut or weakened to define folding line 38.

Figure 6:
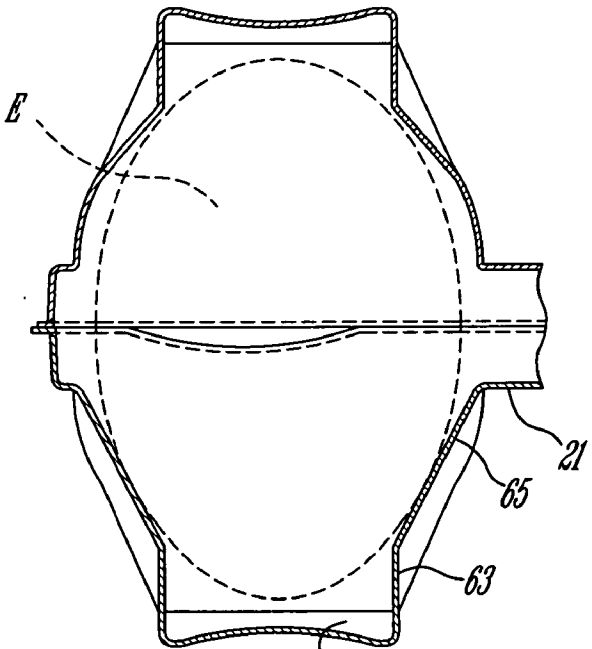
FIG. 6 is a partial view of a cavity containing an egg showing distinct portion of the ribs with respect to the contour of the egg.
Figure 5:
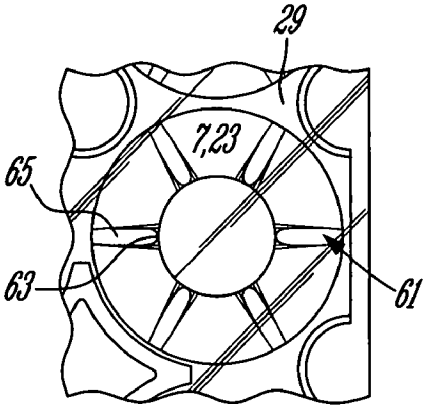
FIG. 5 is a top plan view of a receiving cavity provided with ribs according to the invention.

As illustrated in FIGS. 1 and 6, each egg receiving cavity 23 may be further provided with a set of six inwardly projecting ribs 61 for supporting an egg E, said ribs 61 having a lower portion 63 substantially straight in the bottom of the cavity 23 and an upper portion 65 curved to substantially fit with a corresponding contour of an egg E.

Spacing means 9 may be provided in the base portion 29 between cavities 7, 23 and a periphery 30 of said base portion 29. As illustrated in Figures, spacing means 9 may comprise stoppers 111. These stoppers 111 are all provided with negative angle and are provided with an upper portion 113 and a lower portion 115.

First two-part locking means 41 according to the embodiment illustrated in FIGS. 1 to 9 each have a part 43 provided in the cover portion 21 and a part 45 provided in the base portion 29. These parts engage one into the other to contribute to the improvement of the structural stability of the box to be obtained. Because said parts 43 and 45 are provided with neutral or preferably positive angles, there is no problem to repetitively open and close the cover and mechanical engagement of parts 45 into part 43 as illustrated (or alternatively according to any obvious mechanical equivalent) is sufficient to contribute to the stiffness of the box to be obtained. Preferably, said first two-part locking means 41 are positioned in the bottom of a cavity 42 extending across the width of the cover portion 21 to still further improve the stiffness of the box (once closed). Alternatively, spacing means 9 may be provided on the locking means 41 (in the case of the alternate embodiment of FIGS. 10 to 14) and/or in the base portion 29 between cavities 7,23 and a periphery 30 of said base portion 29 (in the case of both embodiments). As illustrated in the alternative embodiment of FIGS. 10 to 14, spacing means 9 comprise stoppers 91', stoppers 101' and stoppers 111. More particularly, said stoppers 91', 101' and 111 are all provided with negative angle and have the following particulars:

each stopper 91' has an upper portion 93' and a lower portion 95', said stopper 91' being provided in part 43' of the two part interlocking means 41';

each stopper 101' has an upper portion 103' and a lower portion 105', said stopper 101' being provided in part 45 of the interlocking means 41; and each stopper 111' has an upper portion 113' and a lower portion 115'.

In a stack of tray according to the embodiment of FIG. 1, the lower portion 115 of a tray 1 rests on a corresponding upper portion 113 of another tray 1 positioned underneath to thereby prevent neighboring trays to become interlocked together by friction and/or air lock. According to the alternative embodiment of FIG. 10, stoppers 91' have negative angles so as in a stack S of open trays 1', its upper portion 93' supports the lower portion 95' of corresponding first stoppers 91' of a neighboring tray 1' to thereby further prevent neighboring trays to become interlocked together by friction and/or air lock. The tray of FIG. 1 is particularly preferred embodiment of the invention. Indeed, it has been surprisingly found that it is possible to obtain sufficient stiffness of the box even though the first locking means is not snapped as in FIG. 10. This characteristic also contributes to simplify the manufacturing of the tray.

The tray of FIG. 1 is a particularly preferred embodiment of the invention. According to this embodiment, the interlocking means 41 is provided in a cavity 42 that further provide additional rigidity to the cover portion 21.

As illustrated in FIGS. 10 to 14, parts 43' and 45' may define a two part snap fastener where part 43 is sized to be snapped into a bore 44' defined in part 45'. When the box is closed, parts 43', 45' consolidate the structural rigidity of the resulting box. Of course, even if represented as being preferred on the kings of two part snap fasteners may be used.

Furthermore, stopper 91', may have other geometric configuration. Indeed, geometric configuration illustrated in the drawings is only illustrative and not limitative.

As illustrated in FIG. 1, the cover portion 21 may be further provided with at least one substantially flat surface 121 for receiving thereon a printed label, a printed stamp or both. For example, said flat surface 121 may support an advertising label 123. Alternatively information stamp may be printed directly on the surface (example: CUP code and/or peremption date), or both. Optionally, said label 123 may be glued on said surface.

In order to close the box the following steps are carried out.

As illustrated in FIG. 1, the base portion 29 and the cover portion 21 may be further provided with venting means 130. Preferably, said means merely consist in a deformation in the rim of the box EB at the end of the base portion 29 of the tray 1 and at the end of the cover portion 21.

As illustrated in FIGS. 10 to 14, the cover portion 21 is provided with two sets of locking means 41, especially two sets of snap fasteners. Each fastener has a molded portion that engages (i.e. snaps) into a bore 44' upon closure of the cover portion 21 over the base portion 29. The locking means 41 allow the box to have increased rigidity, especially when the size of the box is such that it may be subjected to deformation increasing the risk of damage to its content.

As illustrated in FIGS. 1 to 14, the cover portion 21 is provided with two or three sets of locking means 131, especially sets of friction fastener 133. Each fastener 133 has molded protuberances 135, 137 that are substantially perpendicular to the plane of the original sheet and engages (with friction) one into the other upon closure of the cover portion 21 over the base portion 29.

As illustrated in FIGS. 1 to 14, the cover portion 21 may be further provided with pairs of two parts fastener 141 with an arch between the parts. Each fastener 141 has portions 143, 145 molded in the plastic that engages into the other upon closure of the cover portion 21 over the base portion 29. As illustrated, said portions 143 and 145 are substantially perpendicular to the plane of the original sheet.

The locking means 41, 131 and 141 are not limited to what is illustrated in the drawings and may extend to various other kinds of two part locking means known in the art to be equivalent two part locking means. Two part locking means 131 and 141 contribute to provided additional rigidity to the resulting box.

As illustrated in FIGS. 1 to 14, the cover portion 21 and the base portion 29 may be provided with peripheral flanges 51 and 59 which when the cover portion 21 is folded over the base portion engages one into the other and cooperate with locking means 41, 131 and 141 to provide additional rigidity to the box, especially the egg-box. Also, additional rigidity may be further obtained with recess 81 that are provided in thee wall of the cover portion 21. As illustrated, one part of the second two par locking means may be provided in said recess.

In order to open the box, reversed steps are carried out.

Figure 9:
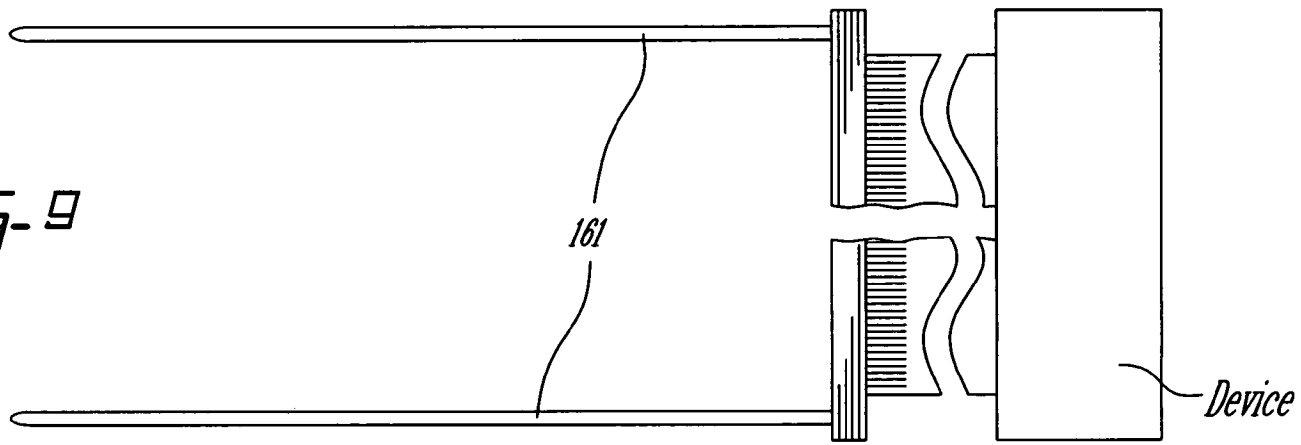
FIG. 9 is a schematic view of a tool allowing to pick up the tray from the stack.

As illustrated in FIGS. 8 and 9, said tray 1 may be further provided with means 151 for facilitating the denesting by an automated packaging and/or labeling apparatus. Preferably, said means may comprises projecting members 153 provided on the outside of cavities 23 near ends of the tray 1. More particularly, projecting members 153 are provided by pair on the outside of each cavities 23 near ends of the tray 1 to thus define a receiving track 155 for a denesting tool 161.

The invention also relates to a stack S of trays 1 as defined hereinbefore.

The invention further relates to a method for denesting trays 1 from a stack S of empty trays 1 to feed an automated packaging and/or labeling apparatus, said method comprising a step in which trays are successively picked up from a stack S of trays 1 as defined hereinbefore. Advantageously, a tool 161 (e.g. a fork like tool) which is part of a packaging and/or labeling apparatus, engages the tracks 155 (on both sides of the tray 1) defined by the projecting members 153 and denests a tray 1 from the bottom of the stack S to feed said apparatus. Preferably, as illustrated, there are 16 projecting members 153, eight on each side of the tray 1. The present invention is not limited to the preferred embodiments recited hereinbefore and also relates to any variation and equivalent that may appear to be obvious to a skilled workman.

What is claimed is:

1. A stackable tray obtained by vacuum molding of a sheet of plastic material, said tray comprising, in open position:

a) a top and a bottom;

b) a plurality of receiving cavities opened upwardly;

c) a hinge portion dividing said tray into a cover portion and a base portion; said receiving cavities being provided in said base portion, and said cover portion defining a substantially flat surface above the receiving cavities when the cover portion is folded over the base portion to close the tray in a closed position to define a box, the substantially flat portion spanning at least partially above all rows of the receiving cavities;

d) spacing means to keep, in a stack of trays, the top portion and the bottom portion of neighboring trays at distance from each other to thereby prevent interlocking therebetween when the trays are in an opened position; and e) at least one two-part locking means, each part being provided in the top of the sheet and positioned to engage one part into the other part when the cover portion is folded over the base portion along the hinge portion to bring the tray into the closed position, the part in the cover portion forming a concavity in the substantially flat surface by projecting from the substantially flat surface toward the base portion when the tray is in the closed position and transversely oriented with respect to the hinge portion to sit on at least two other parts in the base portion such that the part in the cover portion spans over the at least two other parts in the base portion, the parts in the base portion each being positioned between some of the receiving cavities and being separated from one another by row of the receiving cavities.

2. A stackable tray according to claim 1, wherein said spacing means are stoppers having a portion thereof provided with a negative angle, an upper portion and a lower portion, said upper portion and lower portion of each stopper, when said tray is in open position, facing corresponding lower portion and upper portion of neighboring trays to keep a gap between said trays and prevent the trays from becoming interlocked.

3. A stackable tray according to claim 1, wherein said tray defines an egg-box obtained from a rectangular sheet of plastic and provided with a plurality of egg receiving cavities.

4. A stackable tray according to claim 3, wherein the cover portion and the base portion are each provided with a peripheral flange, said flanges being sized to fit one against the other when the cover portion is folded over the base portion along the hinge portion.

5. A stackable tray according to claim 4, wherein said two part locking means comprises at least one first two part locking means and at least one second two part locking means, said first two part locking means being provided in an intermediate portion of the cover portion and base portion; said second locking means being provided in a peripheral portion of the cover portion and base portion.

6. A stackable tray according to claim 4, wherein said peripheral flanges are further shaped to define at least said second two part locking means, each part of said second two part locking means being provided with at least one protuberance engaging a corresponding cavity substantially perpendicularly to the plane of the original sheet.

7. A stackable tray according to claim 6, wherein each egg receiving cavity is further provided with a set of at least three inwardly projecting ribs for supporting an egg, said ribs having a lower portion substantially straight in the bottom of the cavity and an upper portion curved to substantially fit with a corresponding contour of an egg.

8. A stackable tray according to claim 7, wherein each egg receiving cavity is further provided with a set of six inwardly projecting ribs for supporting an egg, said ribs having a lower portion substantially straight in the bottom of the cavity and an upper portion curved to substantially fit with a corresponding contour of an egg.

9. A stackable tray according to claim 8, wherein the base portion is further provided with additional spacing means comprising at least one first stopper provided between cavities of the base portion; said first stopper having negative angles so as in a stack of trays, its upper portion supports the lower portion of corresponding first stopper of a neighboring tray.

10. A stackable tray according to claim 6, wherein the cover portion and the base portion are further provided with a third two part locking means.

11. A stackable tray according to claim 10, wherein the third two part locking means has a first part provided in the base portion and a second part provided in the cover portion, said third two part locking means being positioned in portions of flanges that are opposite the hinge portion.

12. A stackable tray according to claim 3, wherein the cover portion is provided with at least one substantially flat surface for receiving thereon a printed label, a printed stamp or both.

13. A stackable tray according to claim 3, wherein means are provided to facilitate movement of the tray on an automated packaging/labeling apparatus.

14. A stackable tray according to claim 13, wherein said means to facilitate movement of the tray through an automated packaging/labeling apparatus comprise pair of small protuberances provided on the outer face of cavities near end of trays.

15. A stackable tray according to claim 5, wherein the first two part locking means is provided with positive angles in order not to define a snap fastener.

16. A stackable tray according to claim 5, wherein the first two part locking means is provided with negative angles in order to define a snap fastener and, when in open position in a stack of trays, a further spacing means.

17. A stackable according to claim 1, further comprising at least a pair of two-part locking means, with an arch between pairs in the part of the cover portion.

* * * * *